US005962107A

United States Patent [19]

Lowery et al.

[11] Patent Number: 5,962,107

[45] Date of Patent: Oct. 5, 1999

[54] PERFORATED CELLULAR SOUND ABSORPTION MATERIAL

[75] Inventors: Barry Lynn Lowery, Golden; Jeffrey Canon Townsend, Highlands Ranch; Ralph Michael Fay, Lakewood; Kevin Patrick McHugh, Littleton, all of Colo.

[73] Assignee: Johns Manville International, Inc.

[21] Appl. No.: 08/960,465

[22] Filed: Oct. 29, 1997

[51] Int. Cl.[6] ..... B24B 3/24; E04B 1/82

[52] U.S. Cl. ..... 428/131; 428/156; 428/304.4; 181/293; 181/288; 264/48; 264/504; 83/30

[58] Field of Search ..... 428/131, 156, 428/304.4; 181/293, 288; 264/48, 504; 83/30

[56] References Cited

U.S. PATENT DOCUMENTS

| | | | |
|---|---|---|---|
| 3,621,934 | 11/1971 | Thrasher et al. | 181/336 |
| 3,966,526 | 6/1976 | Doerfling | 156/224 |
| 4,097,633 | 6/1978 | Focht | 428/138 |
| 4,150,850 | 4/1979 | Doerfling | 296/137 A |
| 4,211,590 | 7/1980 | Steward et al. | 156/79 |
| 4,340,129 | 7/1982 | Salyers | 181/200 |
| 4,464,428 | 8/1984 | Ebert et al. | 428/95 |
| 4,615,411 | 10/1986 | Breitscheidel et al. | 181/224 |
| 4,715,473 | 12/1987 | Tschudin-Mahrer | 181/286 |
| 4,863,791 | 9/1989 | Steward et al. | 428/310.5 |
| 5,518,806 | 5/1996 | Eder et al. | 428/218 |
| 5,633,067 | 5/1997 | Illbruck et al. | 428/138 |

*Primary Examiner*—William P. Watkins, III
*Attorney, Agent, or Firm*—Robert D. Touslee

[57] ABSTRACT

A cellular material, preferably a low density foam material, having an initial average normal incidence sound absorption coefficient for a selected frequency range is perforated to form a perforated cellular sound absorption material. The perforated cellular sound absorption material formed has an average normal incidence sound absorption coefficient for the selected frequency range greater than the initial average normal incidence sound absorption coefficient of the cellular sound absorption material. The depth(s), diameter(s), shape (s) and pattern of the perforations provide the cellular sound absorption material with the improved sound absorption properties that are reflected in the increased average normal incidence sound absorption coefficient of the material.

24 Claims, 11 Drawing Sheets

PERFORATED CELLULAR SOUND ABSORPTION MATERIAL

BACKGROUND OF THE INVENTION

The present invention relates to a perforated cellular sound absorption material and, in particular, to a perforated cellular sound absorption material for providing greater sound absorption within a selected frequency range and the method of making such a perforated cellular sound absorption material.

Cellular, acoustical insulation materials, such as foams, are commonly used as silencers for heating, ventilating and air conditioning systems; as pipe insulation; as sound enclosures; as sound barrier curtains; as duct linings; and as sound control materials in aircraft fuselages, office partitions and other applications where sound control is desired or required. The sound frequencies to be controlled in most of these applications lie within a broad range extending from 0 to about 10,000 Hertz and frequently, lie within a much more limited frequency range contained within that broad range, e.g. 0 to 2,000 Hertz.

In connection with the present invention, tests were performed on various cellular materials to measure the average normal incidence sound absorption coefficients of the materials over a selected frequency range to determine the relative sound absorption properties of the cellular materials. While there is not necessarily a direct correlation between normal and random incidence sound absorption at any given frequency, tests of the average normal incidence sound absorption properties for different cellular materials over a selected frequency range can be used as a means of determining the relative normal and random incidence sound absorption properties of the different cellular materials over the selected frequency range. Hence, measurements of the average normal incidence sound absorption coefficients for different cellular samples, over a selected frequency range or ranges, were used to determine the relative normal and random incidence sound absorption properties of different cellular materials.

When compared to low density, relatively large cell foam materials, high density reticulated foams, such as 8.0 pound per cubic foot reticulated polyurethane foams having very small cell structures and baseline airflow resistances of about 2,000 Rayls, perform relatively well as sound absorption materials for a frequency range extending from 0 to about 10,000 Hertz. When compared to low density relatively large cell foams, test results show that these high density reticulated foams exhibit relatively high average normal incidence sound absorption properties for the frequency range extending from 0 to about 2,000 Hertz and it is believed that these relatively high average normal incidence sound absorption properties are exhibited for the entire frequency range extending up to about 10,000 Hertz. While the high density reticulated foams exhibit good sound absorption properties, these foam materials are relatively expensive, when compared to low density foams, such as low density polyimide and polyurethane foams, and the relatively high weights of these high density reticulated foams can be a major detriment when considering these materials for certain sound absorption applications where weight must be minimized, such as sound insulation for aircraft fuselages. Thus, there has been a need to provide relatively inexpensive, low density, cellular sound absorption materials which out perform conventional low density, cellular sound absorption materials and are comparable in performance to the high density cellular sound absorption materials, such as the reticulated polyurethane foam discussed above.

SUMMARY OF THE INVENTION

The present invention provides a solution to the need for an inexpensive and preferably, low density cellular sound absorption material which out performs other low density cellular sound absorption materials, such as those discussed above. The sound absorption material of the present invention is a perforated cellular material which, as a result of perforations formed in the surface receiving the sound waves, has an average normal incidence sound absorption coefficient for a selected frequency range greater than the initial average normal incidence sound absorption coefficient of the cellular material.

The perforated sound absorption material of the present invention is formed by perforating a cellular material, having an initial average normal incidence sound absorption coefficient for a selected frequency range, with a plurality of perforations. The diameter(s), the depth(s), shape(s), and the pattern of the perforations formed in the cellular sound absorption material are selected to form a perforated cellular sound absorption material having a normal incidence sound absorption coefficient for the selected frequency range greater than the initial average normal incidence sound absorption coefficient of the cellular material.

Preferably, the cellular sound absorption material is a low density, cellular sound absorption material, such as but not limited to, a polyimide foam, a polyamide foam, or a polyurethane is foam having a density no greater than about two pounds per cubic foot and an initial baseline airflow resistance in excess of 5,000 Rayls. By improving the sound absorption properties of such low density cellular materials over a broad frequency range, e.g. 0 to 2,000 Hertz or 0 to 10,000 Hertz, or over a more limited range, e.g. 800 to 1,200 Hertz, these low density, cellular sound absorption materials can be utilized in sound absorption applications for which they were previous inadequate.

DESCRIPTION OF THE PREFERRED EMBODIMENTS

Figure 1:
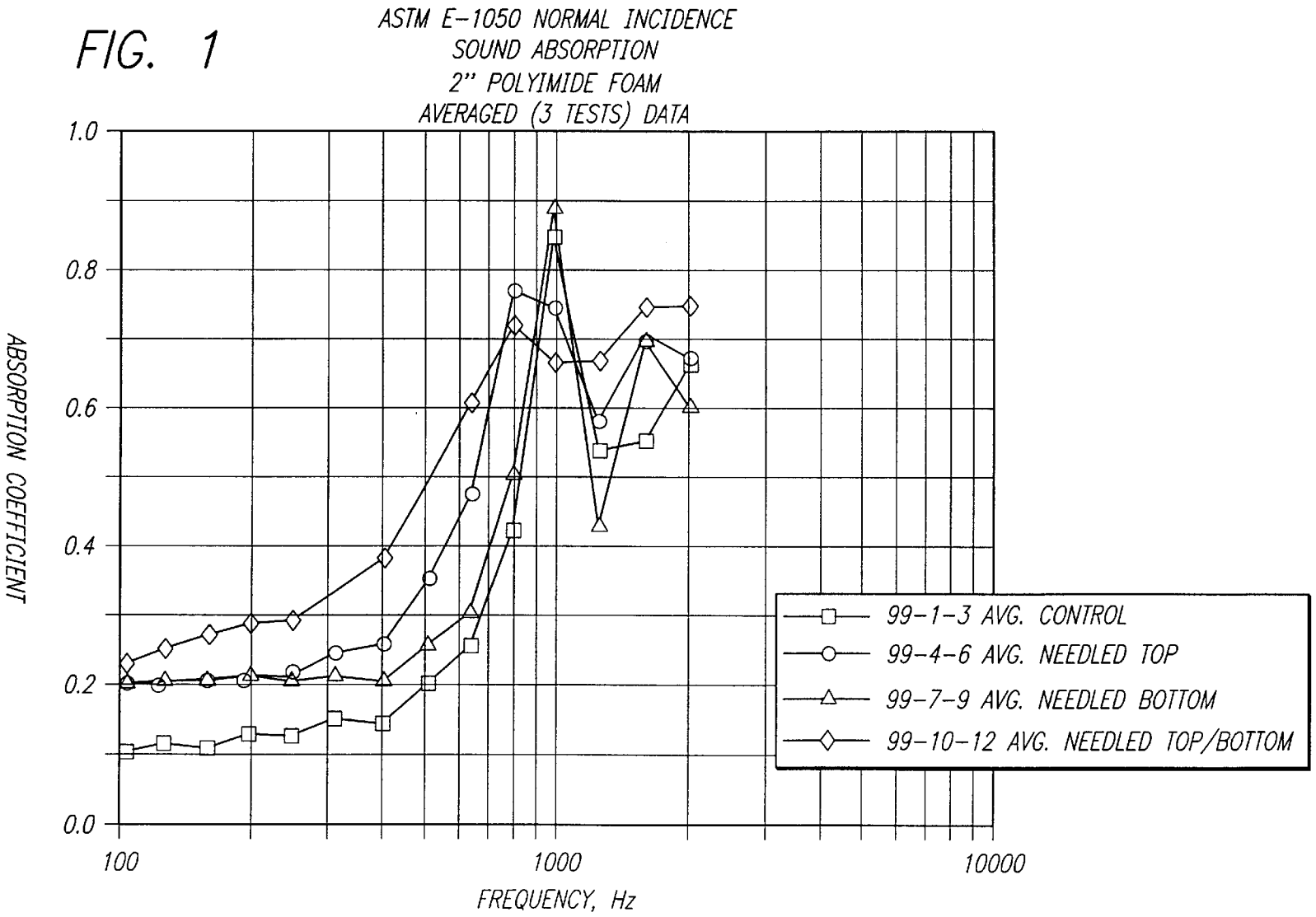
FIG. 1 is a graph comparing the normal incidence sound absorption coefficient of a two inch thick polyimide foam sample, over a frequency range of 0 to 2,000 Hertz, prior and subsequent to the perforation of the sample by needling.

The perforated cellular sound absorption material of the present invention 20 is a cellular material, such as but not limited to, a low density (less than two pounds per cubic foot) cellular material having a baseline airflow resistance greater than 5,000 Rayls. Examples of cellular materials that can be used as the cellular materials of the present invention are polymeric foam materials, such as but not limited to, polyimide, polyamide, and polyurethane foam materials.

In many applications, such as aircraft fuselages, office partitions, etc., there is only a limited space (e.g. less than two inches) available for the perforated cellular sound absorption material 20 to perform its function. Thus it is important to optimize the sound absorption properties of these perforated cellular sound absorption materials for material thicknesses of about two inches or less.

While the invention is not limited to low density cellular materials, higher density cellular materials, such as eight pound per cubic foot, reticulated polyurethane foams having baseline airflow resistances of about 2,000 Rayls, exhibit good sound absorption properties in an unperforated state and forming perforations in the sound receiving surfaces of such cellular materials does not appreciably improve the sound absorption properties of the cellular material and may even have an adverse effect on the sound absorption properties of the cellular material. Where a low density cellular material has a low baseline airflow resistance of about 2,000 Rayls or less, such as a one pound per cubic foot polyurethane foam having a baseline airflow resistance of about 175 Rayls, the formation of perforations in the sound receiving surface of the cellular material does not appreciably improve the sound absorption properties of the cellular material and may even have an adverse effect on the sound absorption properties of the cellular material.

Forming perforations in low density (e.g. less than two pounds per cubic foot) cellular materials having relatively high initial airflow resistances greater than 5,000 Rayls, reduces the 10 airflow resistances of the cellular materials and enhances the sound absorptions properties of the cellular materials. As discussed below in connection with FIGS. 1–10, tests conducted on a 0.68 pound per cubic foot polyimide foam material having an initial baseline airflow resistance of about 20,000 Rayls, have shown that perforating such cellular materials greatly improved the sound absorption properties of the cellular materials. While there appears to be no direct correlation between the extent of the decrease in the airflow resistance of a cellular material resulting from the formation of perforations in the material and the improvement in its sound absorption properties, it does appear that for cellular materials having an initial baseline airflow resistances greater than 5,000 Rayls, the best sound absorption properties are obtained when the baseline airflow resistance of the perforated cellular material ranges from about 500 to about 4,000 Rayls and preferably, from about 500 to about 2,500 Rayls.

Figure 15:
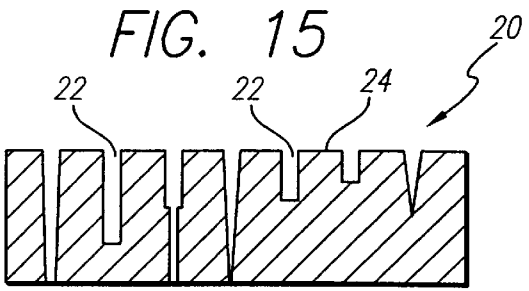
FIG. 15 is a section through the thickness of a cellular sound absorption material showing seven different perforations which can be used in the perforated cellular sound absorption material of the present invention.

The perforations 22 formed in the sound receiving surface 24 of the cellular sound absorption material 20 of the present invention can be formed by any suitable means, such as but not limited to, needling, drilling, and water jet piercing. FIG. 15 shows examples of seven different perforations 22 which can be used in the perforated cellular sound absorption material 20.

As shown the depths of the perforations 22, used in the perforated cellular sound absorption material 20, can be varied (e.g. 25%, 50%, 75% and 100% of the cellular material thickness). The individual perforations 22 in any one cellular sound absorption material can all have the same depth or the depths of different perforations 22 in the cellular sound absorption material 20 can be varied to obtain the desired sound absorption properties. Preferably, the diameters of the perforations 22 at the sound receiving surface 24 of the perforated cellular sound absorption material 20 are less than 0.25 inches, and typically range from about 0.05 inches to about 0.20 inches. Different transverse longitudinal cross sections can be used for the perforations 22. FIG. 15 shows examples of cylindrical, conical, and stepped perforations 22 which are suitable for the perforated cellular sound absorption material 20. The individual perforations 22 in any one cellular sound absorption material 20 can all have the same longitudinal transverse cross section or the transverse longitudinal cross sections of different perforations 22 in the cellular sound absorption material 20 can be varied to obtain the desired sound absorption properties.

Figure 12:
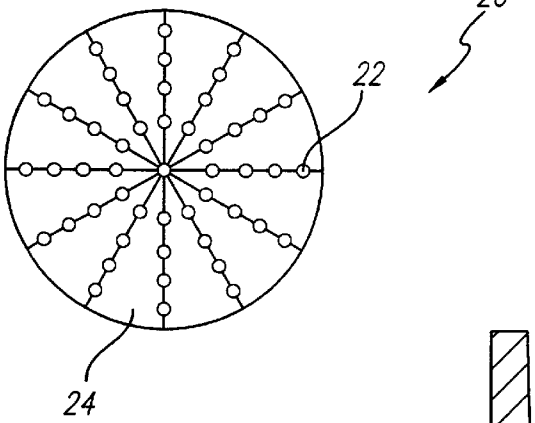
FIGS. 11, 12, 13 and 14 are schematic views showing examples of four different perforation grid patterns which can be used in the perforated cellular sound absorption material of the present invention.
Figure 14:
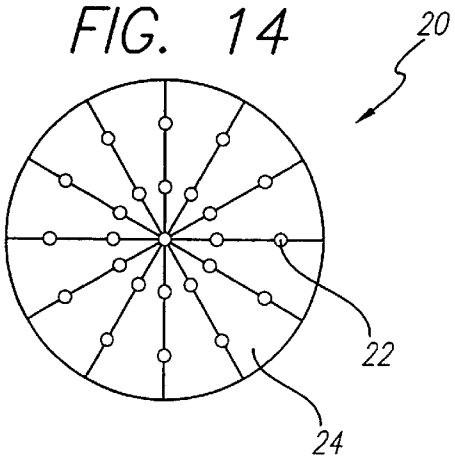
Figure 11:
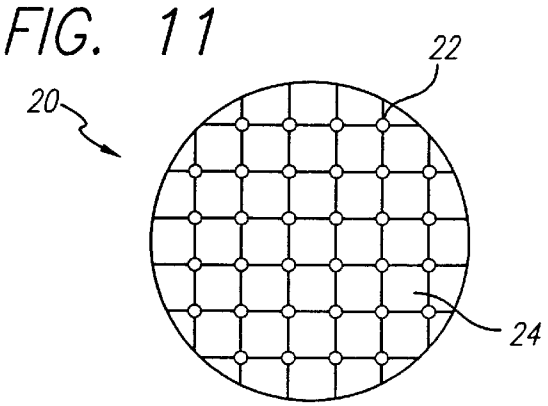
Figure 13:
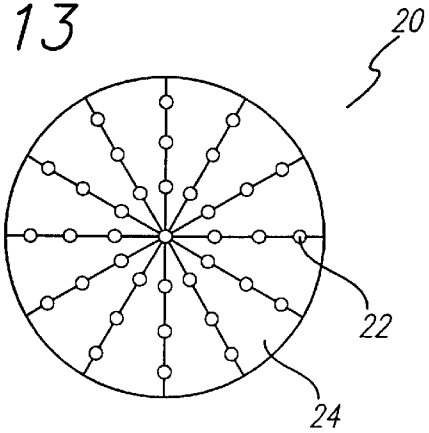

FIGS. 11–14 show examples of several perforation patterns for the perforated cellular sound absorption material 20. The pattern shown in FIG. 11 is a 0.557 inch center to center grid pattern. The patterns shown in FIGS. 12–14 are annular grid patterns having different center to center spacings. In addition to the grid patterns shown in FIGS. 11–14, other grid patterns can also be used for the perforated cellular sound absorption material including grid patterns with different center to center spacings and for certain applications, a random perforation pattern can be used.

In addition to improving the sound absorption properties of cellular sound absorption materials over a broad range of frequencies from 0 to 10,000 Hertz, cellular sound absorption materials can be perforated to improve the sound absorption properties of the cellular material for a more limited frequency range within the broader range of 0 to 10,000 Hertz, such as but not limited to a range of 500 Hertz or 1,000 Hertz. Thus, if sound absorption is required or desired for a particular frequency range within the broad range of 0 to 10,000 Hertz (e.g. a limited range from 1,000 to 1,500 Hertz or 250 to 1,250 Hertz), a cellular sound absorption material can be perforated to optimize the sound absorption properties of the material for the selected frequency range. Of course, perforating a cellular material to improve the sound absorption properties of the cellular material within a limited frequency range may also improve the average sound absorption properties of the material over a much broader frequency range.

Tests were performed on 0.68 pound per cubic foot polyimide foam samples having initial baseline airflow resistances of about 20,000 Rayls. Other than the needled polyimide foam samples that were tested, the polyimide foam samples were perforated using a 0.557 inch center to center square grid pattern such as the grid pattern shown in FIG. 11. The perforation depths compared were 0%, 50% and 100% of the sample thicknesses.

The normal incidence sound absorption coefficient values, which were averaged to obtain the plot points of the graphs of FIGS. 1 to 10, were measured in accordance with ASTM E 1050 testing procedures over a frequency range of 0 to 2,000 Hertz. The baseline airflow resistances prior to the perforation of the samples and the airflow resistances of the perforated samples were measured in accordance with ASTM C 522 testing procedures.

All samples were cut and tested for an initial or baseline airflow resistance (ASTM C 522) and normal incidence sound absorption (ASTM E 1050) using an exact frequency program at 0% penetration. Except for the needled samples, the samples were then drilled to a 50% penetration depth using a 0.05 inch diameter drill bit and retested. The samples were then drilled to a 100% penetration depth using the 0.05 inch diameter drill bit and retested. The same samples were then drilled through the original 0.05 inch perforations to a 50% penetration depth and a 100% penetration depth using a 0.1 inch diameter drill bit and retested at both the 50% and 100% penetration depths. The same samples were then drilled through the original 0.1 inch perforations to a 50% penetration depth and a 100% penetration depth using a 0.2 inch diameter drill bit and retested at both the 50% and 100% penetration depths. Thus, the samples tested subsequent to the initial perforation of the samples at a 50% penetration depth had stepped perforations such as those shown in FIG. 15.

With respect to FIG. 1, FIG. 1 shows the averaged values from three individual tests. It can be seen from the graph that sound absorption properties of the two inch thick polyimide foam samples in the low frequencies (100–800 Hertz) are increased when the foam samples are needled from either the top or the bottom. Needling the foam sample from the bottom provided an average increase in the absorption performance of about 40%, at all frequencies except 1248 and 2,000 Hertz, over the unperforated control sample. Needling the sample from the top provided an average increase in the absorption performance of about 58%, at all frequencies except 1,000 Hertz, over the unperforated control sample. Needling the sample from both the top and the bottom provided an average increase in the absorption performance of about 97% at all frequencies, over the unperforated control sample.

Figure 2:
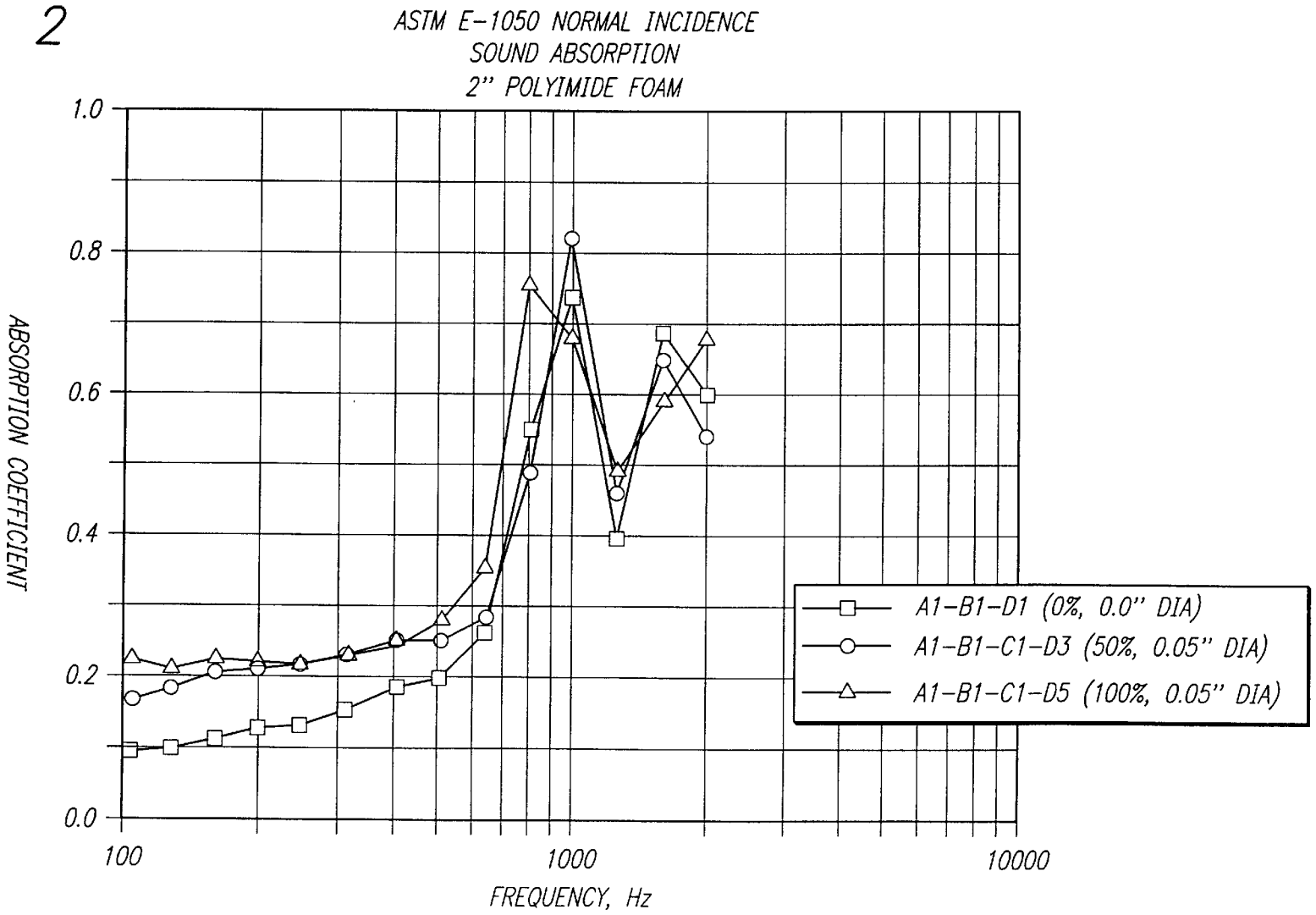
FIG. 2 is a graph comparing the normal incidence sound absorption coefficient of a two inch thick polyimide foam sample, over a frequency range of 0 to 2,000 Hertz, prior and subsequent to the formation of 0.05 inch diameter perforations in the sample.

FIG. 2 shows the effects of perforating the two inch thick polyimide foam sample with 0.05 inch diameter perforations at 50% and 100% penetration. The increase in the average normal incidence sound absorption coefficient of the polyimide foam sample over a frequency range of 104 to 2,000 Hertz was about 36% at 50% penetration and about 51% at 100% penetration. The airflow resistance of the polyimide foam sample was about 13,548 Rayls at 50% penetration and about 5,739 Rayls at 100% penetration. The unperforated polyimide foam control sample displayed a peak at 1,000 Hertz. The 50% penetration curve also peaks at 1,000 Hertz, but at a higher value. The peak of the 100% penetration curve shifted 200 Hertz to 800 Hertz thereby providing the opportunity to more effectively absorb sound at this frequency if desired or required for a particular application.

Figure 3:
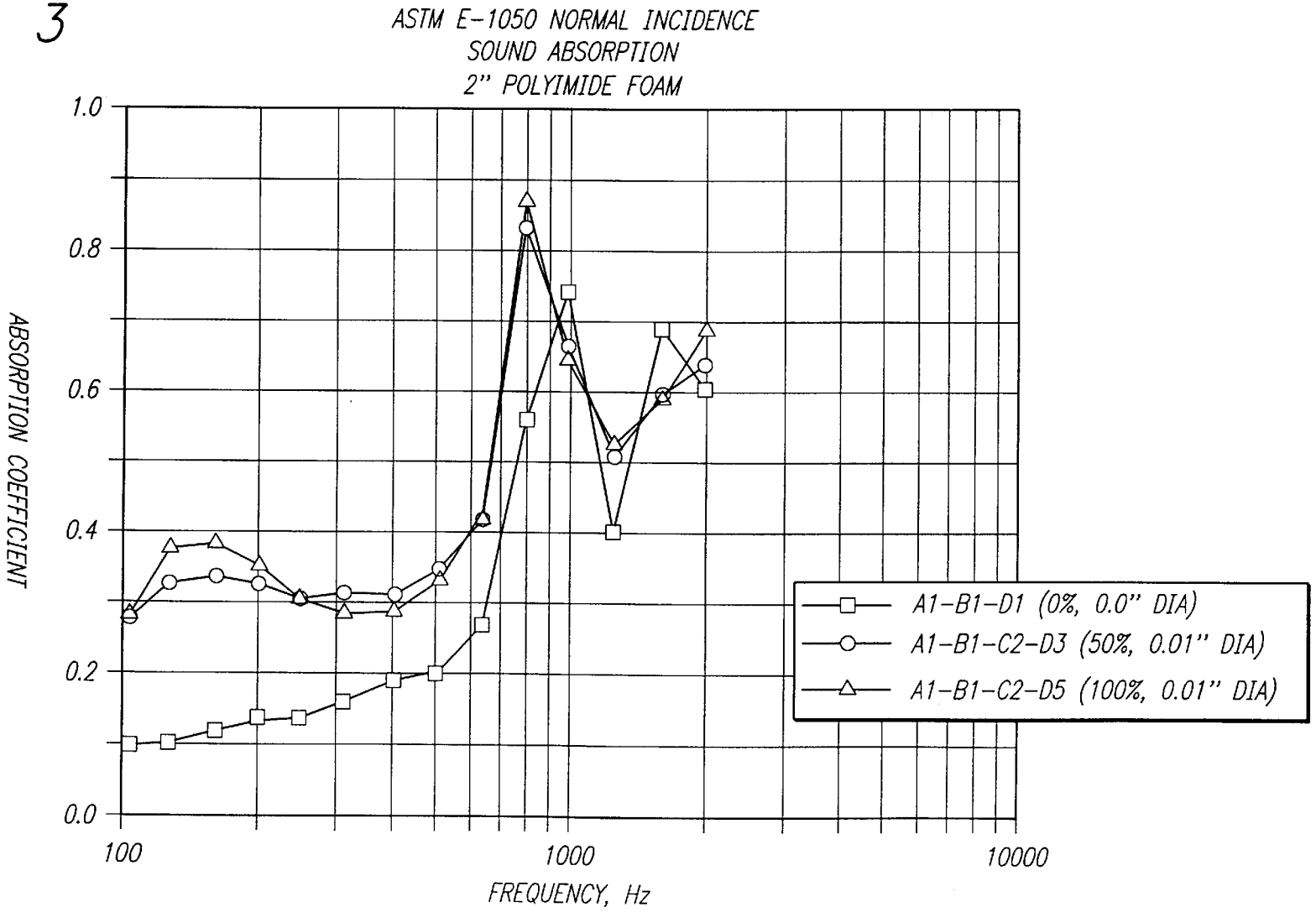
FIG. 3 is a graph comparing the normal incidence sound absorption coefficient of a two inch thick polyimide foam sample, over a frequency range of 0 to 2,000 Hertz, prior and subsequent to the formation of 0.1 inch diameter perforations in the sample.

FIG. 3 shows the effects of perforating the two inch thick polyimide foam sample with 0.1 inch diameter perforations at 50% and 100% penetration. The increase in the average normal incidence sound absorption coefficient of the polyimide foam sample over a frequency range of 104 to 2,000 Hertz was about 88% at 50% penetration and about 96% at 100% penetration. The airflow resistance of the polyimide foam sample was about 3,603 Rayls at 50% penetration and about 1,360 Rayls at 100% penetration. The unperforated polyimide foam control sample displayed a peak at 1,000 Hertz. However, the peaks of the 50% and the 100% penetration curves shifted 200 Hertz to 800 Hertz and have higher values than the control sample thereby providing the opportunity to more effectively absorb sound at this frequency if desired or required for a particular application.

In addition, there are low frequency peaks in the 50% and 100% penetration curves at 100 to 300 Hertz.

Figure 4:
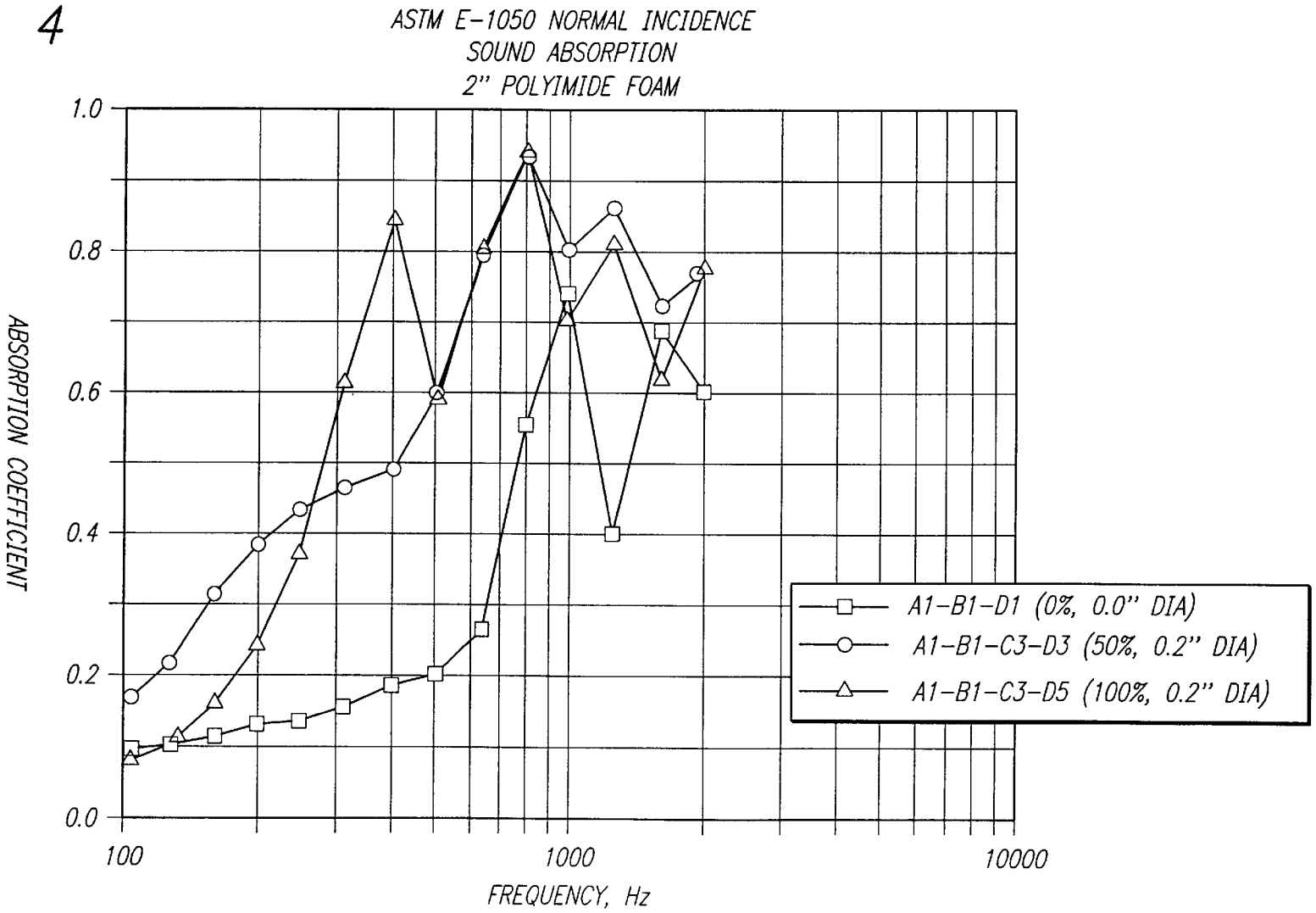
FIG. 4 is a graph comparing the normal incidence sound absorption coefficient of a two inch thick polyimide foam sample, over a frequency range of 0 to 2,000 Hertz, prior and subsequent to the formation of 0.2 inch diameter perforations in the sample.

FIG. 4 shows the effects of perforating the two inch thick polyimide foam sample with 0.2 inch diameter perforations at 50% and 100% penetration. The increase in the average normal incidence sound absorption coefficient of the polyimide foam sample over a frequency range of 104 to 2,000 Hertz was about 127% at 50% penetration and about 111% at 100% penetration. The airflow resistance of the polyimide foam sample was about 1,104 Rayls at 50% penetration and about 26 Rayls at 100% penetration. The unperforated polyimide foam control sample displayed a peak at 1,000 Hertz. However, the peaks of the 50% and the 100% penetration curves shifted 200 Hertz to 800 Hertz and have higher values than the control sample. The average normal incidence sound absorption coefficients for the 50% and the 100% penetration curves were increased relative to the control sample for frequencies greater than 1,000 Hertz thereby providing the opportunity to more effectively absorb sound within these frequency ranges if desired or required for a particular application. In addition, there is a slight low frequency peak in the 50% penetration curve and a sub-peak in the 100% penetration curve at 400 Hertz. The optimum sound absorption versus airflow resistance for the two inch thick polyimide foam sample was between 500 and 1,103 Rayls.

Figure 5:
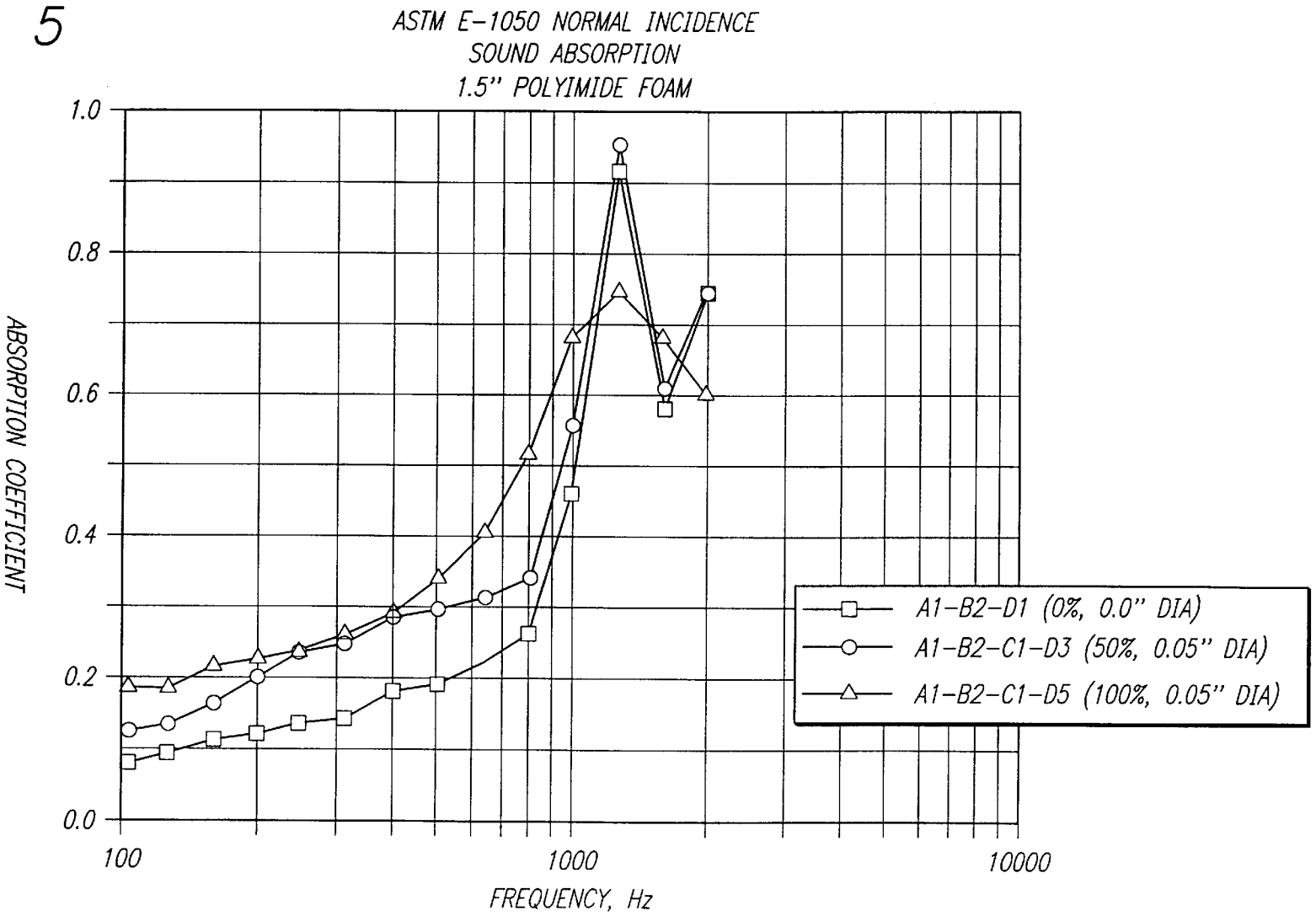
FIG. 5 is a graph comparing the normal incidence sound absorption coefficient of an one and one-half inch thick polyimide foam sample, over a frequency range of 0 to 2,000 Hertz, prior and subsequent to the formation of 0.05 inch diameter perforations in the sample.

FIG. 5 shows the effects of perforating a one and one-half inch thick polyimide foam sample with 0.05 inch diameter perforations at 50% and 100% penetration. The increase in the average normal incidence sound absorption coefficient of the polyimide foam sample over a frequency range of 104 to 2,000 Hertz was about 55% at 50% penetration and about 53% at 100% penetration. The airflow resistance of the polyimide foam sample was about 19,471 Rayls at 50% penetration and about 5,402 Rayls at 100% penetration. The unperforated polyimide foam control sample displayed an absorption peak at 1,248 Hertz. The 50% penetration curve shows a low frequency increase between 100 and 1,000 Hertz, but is otherwise similar to the control curve. The 100% penetration curve shows a loss of absorption at the control peak, but an overall increase in absorption over a wider range of frequencies.

Figure 6:
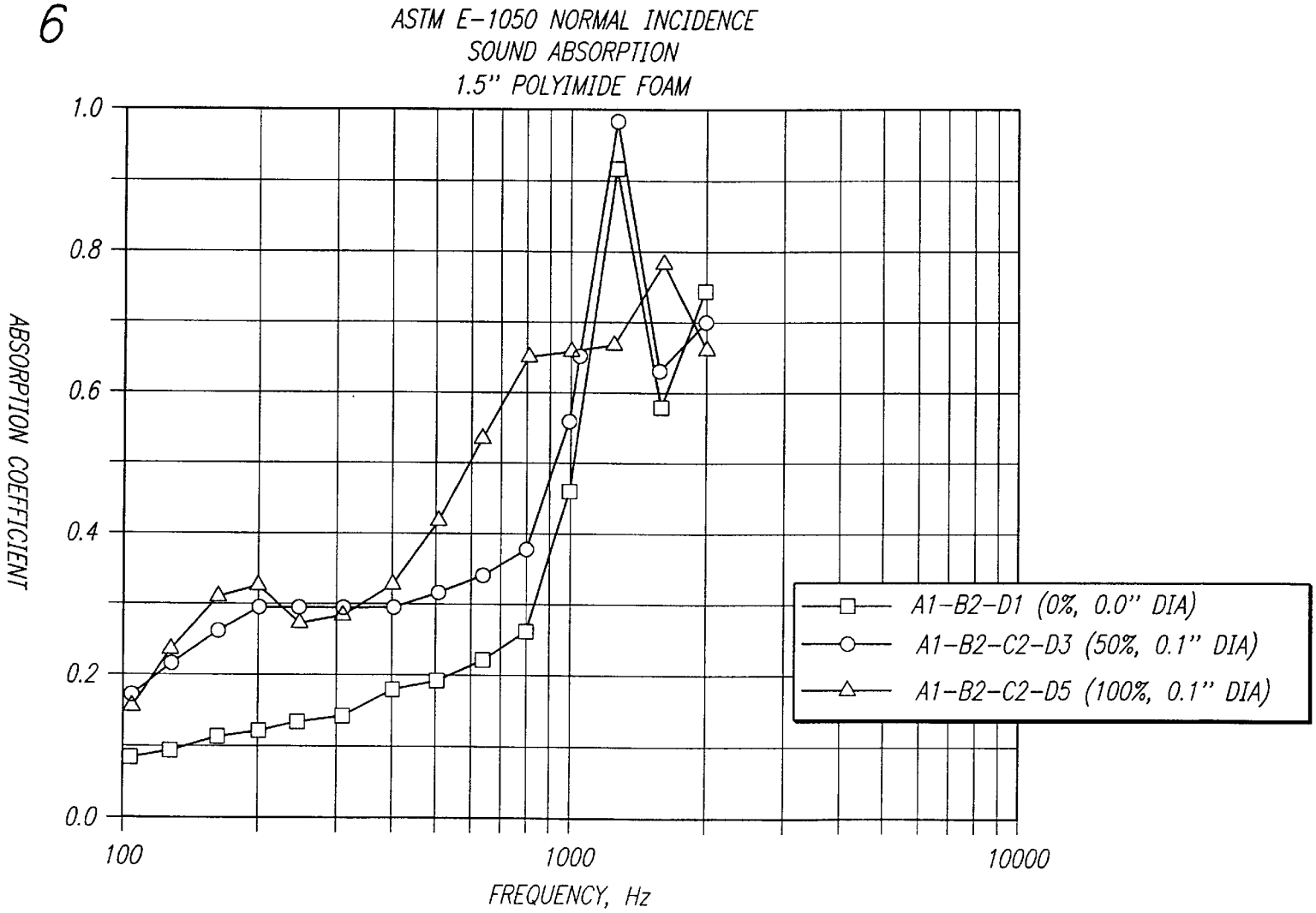
FIG. 6 is a graph comparing the normal incidence sound absorption coefficient of an one and one-half inch thick polyimide foam sample, over a frequency range of 0 to 2,000 Hertz, prior and subsequent to the formation of 0.1 inch diameter perforations in the sample.

FIG. 6 shows the effects of perforating a one and one-half inch thick polyimide foam sample with 0.1 inch diameter perforations at 50% and 100% penetration. The increase in the average normal incidence sound absorption coefficient of the polyimide foam sample over a frequency range of 104 to 2,000 Hertz was about 110 % at 50% penetration and about 119% at 100% penetration. The airflow resistance of the polyimide foam sample was about 3,724 Rayls at 50% penetration and about 1,114 Rayls at 100% penetration. The 50% and the 100% penetration curves both show a low frequency increase between 100 and 1,000 Hertz, and the 100% penetration curve shows a sub-peak between 100 and 300 Hertz.

Figure 7:
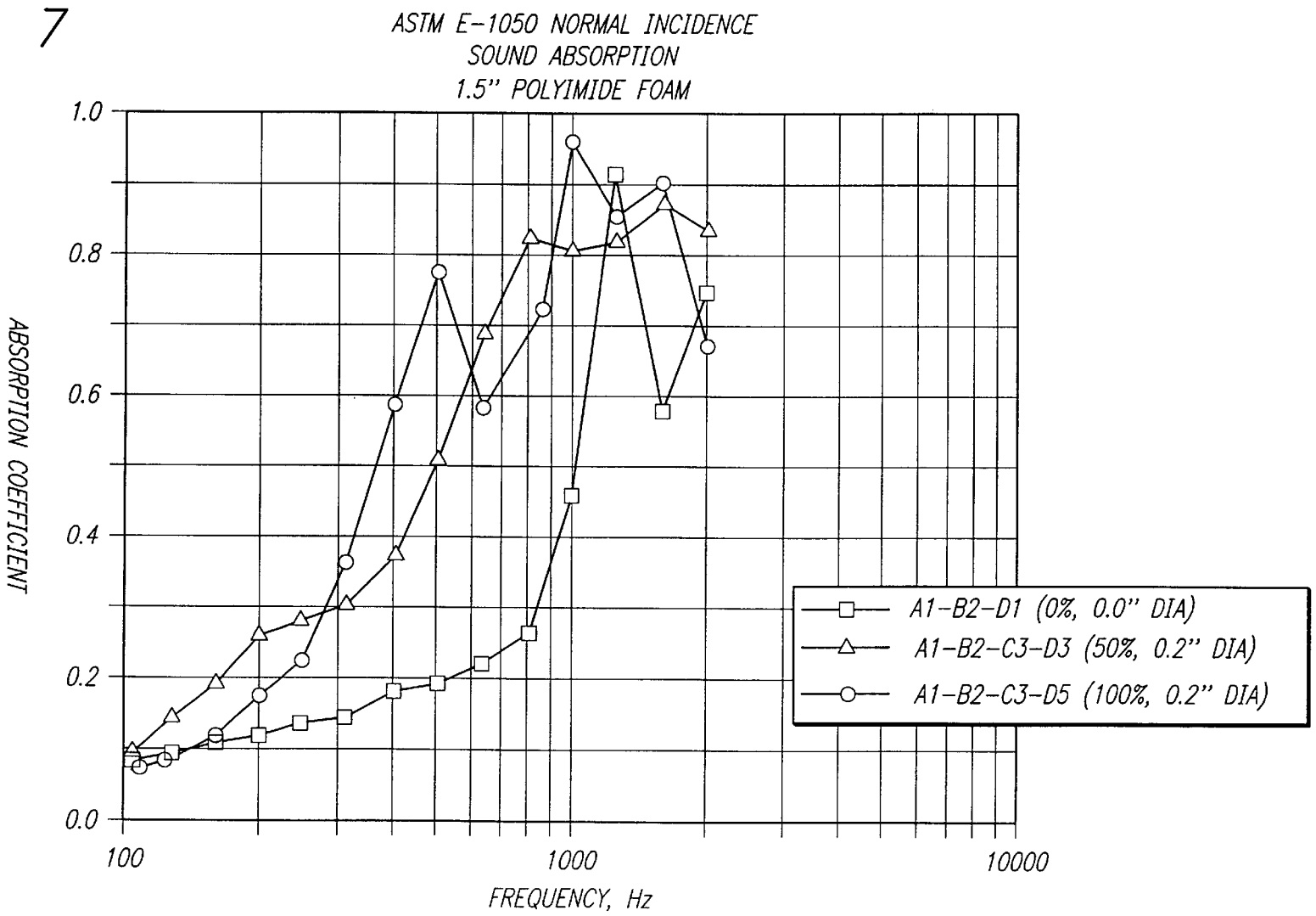
FIG. 7 is a graph comparing the normal incidence sound absorption coefficient of an one and one-half inch thick polyimide foam sample, over a frequency range of 0 to 2,000 Hertz, prior and subsequent to the formation of 0.2 inch diameter perforations in the sample.

FIG. 7 shows the effects of perforating a one and one-half inch thick polyimide foam sample with 0.2 inch diameter perforations at 50% and 100% penetration. The increase in the average normal incidence sound absorption coefficient of the polyimide foam sample over a frequency range of 104 to 2,000 Hertz was about 150% at 50% penetration and about 131% at 100% penetration. The airflow resistance of the polyimide foam sample was about 1,196 Rayls at 50% penetration and about 27 Rayls at 100% penetration. This graph shows a 200 Hertz shift to 1,000 Hertz in the peak of the 100% penetration curve. In addition, the 50% and the 100% penetration curves both show a low frequency increase between 100 and 1,000 Hertz, and the 100% penetration curve shows a sub-peak 500 Hertz.

Figure 8:
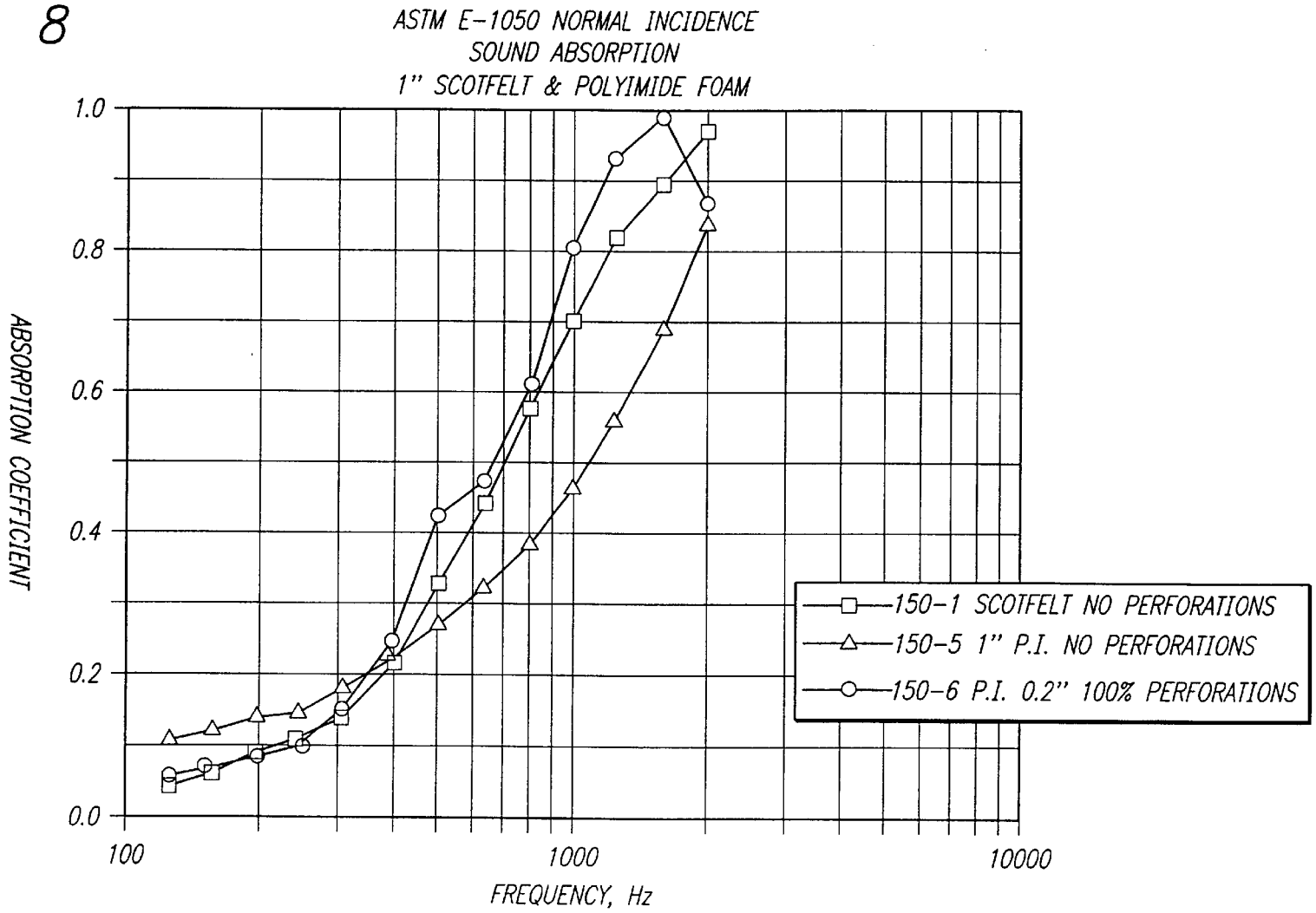
FIG. 8 is a graph comparing the normal incidence sound absorption coefficient of an one inch thick polyimide foam sample and an one inch thick reticulated polyurethane foam sample, over a frequency range of 0 to 2,000 Hertz, prior and subsequent to the formation of 0.2 inch diameter perforations in the polyimide foam sample.

FIG. 8 shows the effect of perforating a one inch thick polyimide foam sample with 0.2 inch diameter perforations at 100% penetration and compares the sound absorption properties of the perforated polyimide foam sample with the polyimide foam sample prior to perforation and a one inch thick 8.0 pound per cubic foot reticulated polyurethane foam sample (SCOTTFELT foam). The increase in the average normal incidence sound absorption coefficient of the polyimide foam sample over a frequency range of 128 to 2,000 Hertz was about 31% at 100% penetration. In addition, the average normal incidence sound absorption coefficient of the perforated polyimide foam sample at 100% penetration over a frequency range of 128 to 2,000 Hertz was about 8% greater than the reticulated polyurethane foam sample and the sound absorption of the perforated polyimide foam sample exceeded that of the reticulated polyurethane foam sample up to a frequency of about 1,060 Hertz.

Figure 9:
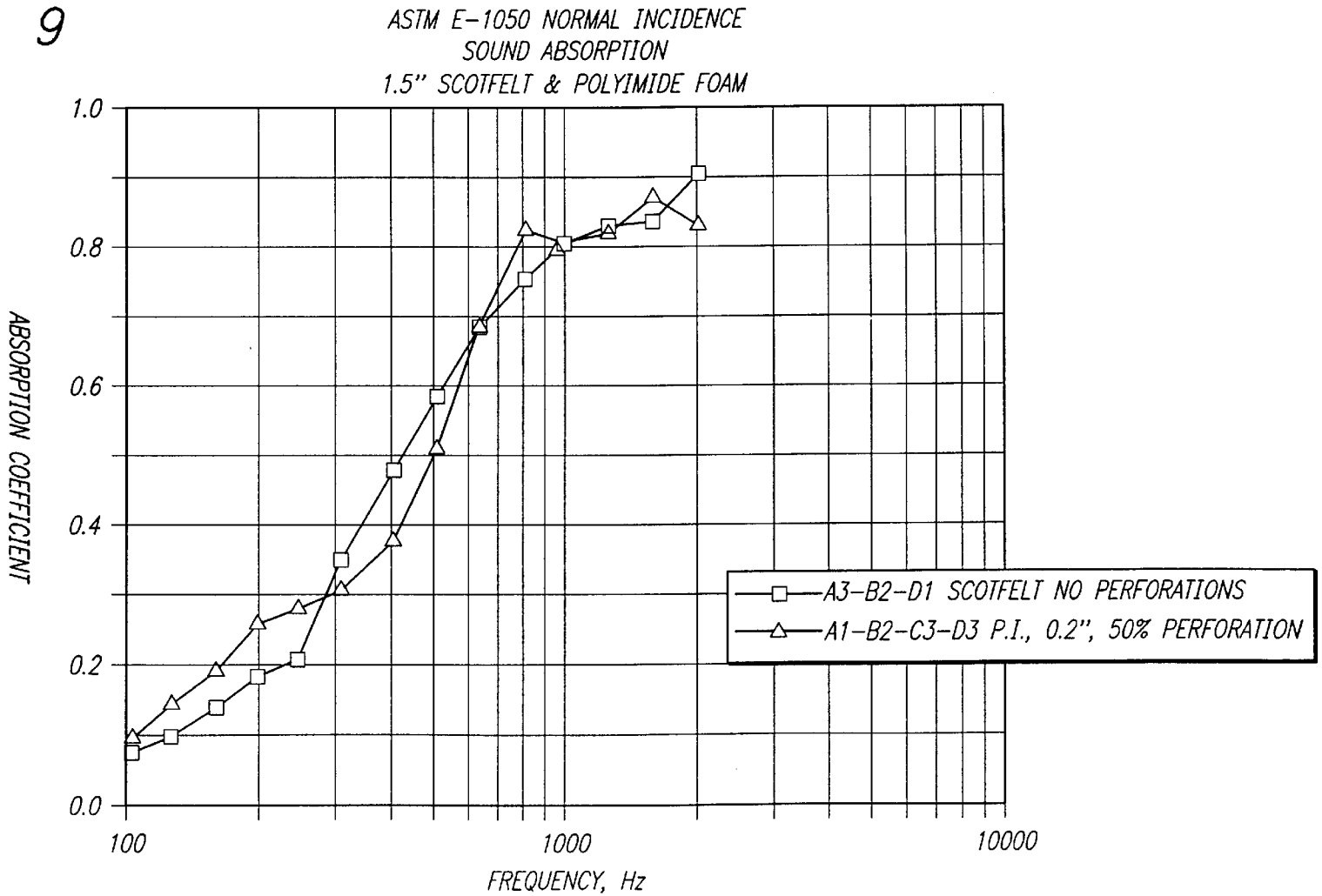
FIG. 9 is a graph comparing the normal incidence sound absorption coefficient of an one and one-half inch thick polyimide foam sample and an one and one-half inch thick reticulated polyurethane foam sample, over a frequency range of 0 to 2,000 Hertz, subsequent to the formation of 0.2 inch diameter perforations in the polyimide foam sample.
Figure 10:
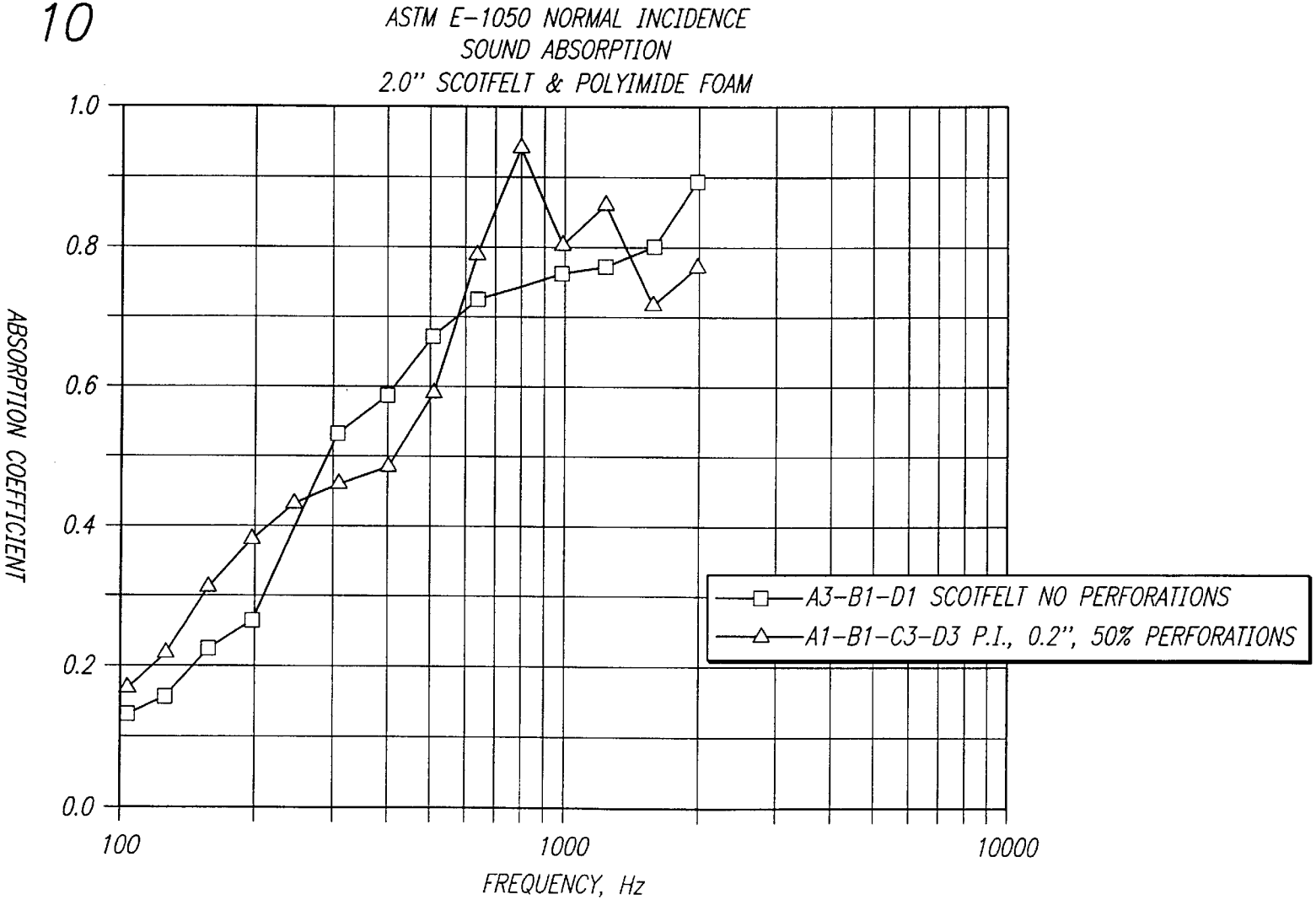
FIG. 10 is a graph comparing the normal incidence sound absorption coefficient of a two inch thick polyimide foam sample and a two inch thick reticulated polyurethane foam sample, over a frequency range of 0 to 2,000 Hertz, subsequent to the formation of 0.2 inch diameter perforations in the polyimide foam sample.

FIGS. 9 and 10 show the effect of perforating a one and one-half inch and two inch thick polyimide foam samples with 0.2 inch diameter perforations at 50% penetration and compares the sound absorption properties of the perforated polyimide foam samples and 8.0 pound per cubic foot reticulated polyurethane foam samples (SCOTTFELT foam) of comparable thicknesses. The average normal incidence sound absorption coefficients of the polyimide foam samples over a frequency range of 104 to 2,000 Hertz was about the same as the average normal incidence sound absorption coefficient of the reticulated polyurethane foam sample. However, the perforated polyimide foam samples were only about 0.6 pounds per cubic foot while the reticulated polyurethane foam sample was about 8.0 pounds per cubic foot.

The tests demonstrate that forming perforations in cellular sound absorption materials having high baseline airflow resistances (preferably greater than 5,000 Rayls), especially low density cellular materials having high baseline airflow resistances, can greatly improve the sound absorption properties of the cellular materials. The tests also demonstrate that at a certain point, further decreasing the airflow resistance of the cellular material with perforations no longer continues to improve the sound absorption properties of the cellular material (FIGS. 4 and 7, 100% penetration curves and lower airflow resistances vs 50% penetration curves and higher airflow resistances). While forming perforations in cellular sound absorption materials is relatively inexpensive, when forming the perforated cellular sound absorption materials of the present invention, an increase in the average normal incidence sound absorption coefficient of at least 15% is generally sought for the selected frequency range and an increase in the average normal incidence sound absorption coefficient of at least 25% is preferred for the selected frequency range. However, for certain applications where the sound absorption properties of the cellular sound absorption material need to be only slightly improved to fulfill the requirements of the application, a lower increase in the average normal incidence sound absorption coefficient for the selected frequency range is acceptable.

In describing the invention, certain embodiments have been used to illustrate the invention and the practices thereof. However, the invention is not limited to these specific embodiments as other embodiments and modifications within the spirit of the invention will readily occur to those skilled in the art on reading this specification. Thus, the invention is not intended to be limited to the specific embodiments disclosed, but is to be limited only by the claims appended hereto.

What is claimed is:

1. A perforated cellular sound absorption material comprising:

a perforated cellular foam material; the perforations having an average diameter no greater than about 0.25 inches; the perforated cellular material having a density of less than about 2.0 pounds/ft$^3$; the perforated cellular material having an average normal incidence sound absorption coefficient for a selected frequency range between 0 Hertz and 10,000 Hertz greater than an initial average normal incidence sound absorption coefficient of the cellular material for the selected frequency range prior to the formation of the perforations in the cellular material; and the cellular material having an initial baseline airflow resistance in excess of 5000 Rayls prior to the formation of the perforations; and the perforated cellular material having an airflow resistance less than the initial baseline airflow resistance of the cellular material prior to the formation of the perforations.

2. The perforated cellular sound absorption material of claim 1, wherein: the average normal incidence sound absorption coefficient of the perforated cellular material for the selected frequency range is at least 15% greater than the initial average normal incidence sound absorption coefficient of the cellular material for the selected frequency range.

3. The perforated cellular sound absorption material of claim 1, wherein: the average normal incidence sound absorption coefficient of the perforated cellular material for the selected frequency range is at least 25% greater than the initial average normal incidence sound absorption coefficient of the cellular material for the selected frequency range.

4. The perforated cellular sound absorption material of claim 2, wherein: the selected frequency range is from 0 Hertz to 2000 Hertz.

5. The perforated cellular sound absorption material of claim 4, wherein: the selected frequency range is a limited frequency range within the frequency range of 0 Hertz to 2000 Hertz; and the limited frequency range has a magnitude of less than 500 Hertz.

6. The perforated cellular sound absorption material of claim 1, wherein: the perforation depth of the perforations in the perforated cellular material is 100% of the thickness of the perforated cellular material.

7. The perforated cellular sound absorption material of claim 1, wherein: the average perforation depth of the perforations in the perforated cellular material is equal to at least 50% of the thickness of the perforated cellular material.

8. The perforated cellular sound absorption material of claim 1, wherein: the average perforation depth of the perforations in the perforated cellular material is equal to at least 25% of the thickness of the perforated cellular material.

9. The perforated cellular sound absorption material of claim 1, wherein: the airflow resistance of the perforated cellular material is between 500 Rayls and 4000 Rayls.

10. The perforated cellular sound absorption material of claim 1, wherein: the baseline airflow resistance of the perforated cellular material is at least 20% less than the initial baseline airflow resistance.

11. The perforated cellular sound absorption material of claim 1, wherein: the selected frequency range is from 0 Hertz and 2000 Hertz.

12. The perforated cellular sound absorption material of claim 1, wherein: the selected frequency range is a limited frequency range within the frequency range of 0 Hertz to 2000 Hertz; and the limited frequency range has a magnitude of less than 500 Hertz.

13. A method of making a perforated cellular sound absorption material comprising:

providing a cellular material having a density of less than 2.0 pounds/ft$^3$, an initial average normal incidence sound absorption coefficient for a selected frequency range between 0 and 10.000 Hertz, and an initial baseline airflow resistance in excess of 5000 Rayls; and perforating the cellular material, with perforations having an average diameter no greater than 0.25 inches, to form a perforated cellular material having an average normal incidence sound absorption coefficient for the selected frequency range greater than the initial average normal incidence sound absorption coefficient of the cellular material and an airflow resistance less than the initial baseline airflow resistance of the cellular material.

14. The method of making a perforated cellular sound absorption material according to claim 13, wherein: the average normal incidence sound absorption coefficient of the perforated cellular material for the selected frequency range is at least 15% greater than the initial average normal incidence sound absorption coefficient of the cellular material for the selected frequency range.

15. The method of making a perforated cellular sound absorption material according to claim 13, wherein: the average normal incidence sound absorption coefficient of the perforated cellular material for the selected frequency range is at least 25% greater than the initial average normal incidence sound absorption coefficient of the cellular material for the selected frequency range.

16. The method of making a perforated cellular sound absorption material according to claim 14, wherein: the selected frequency range is from 0 Hertz and 2000 Hertz.

17. The method of making a perforated cellular sound absorption material according to claim 16, wherein: the selected frequency range is a limited frequency range within the frequency range of 0 Hertz to 2000 Hertz; and the limited frequency range has a magnitude of less than 500 Hertz.

18. The method of making a perforated cellular sound absorption material according to claim 13, wherein: the perforation depth of the perforations in the perforated cellular material is 100% of the thickness of the perforated cellular material.

19. The method of making a perforated cellular sound absorption material according to claim 13, wherein: the average perforation depth of the perforations in the perforated cellular material is equal to at least 50% of the thickness of the perforated cellular material.

20. The method of making a perforated cellular sound absorption material according to claim 13, wherein: the average perforation depth of the perforations in the perforated cellular material is equal to at least 25% of the thickness of the perforated cellular material.

21. The method of making a perforated cellular sound absorption material according to claim 13, wherein: the airflow resistance of the perforated cellular material is between 500 Rayls and 4000 Rayls.

22. The method of making a perforated cellular sound absorption material according to claim 13, wherein: the airflow resistance of the perforated cellular material is at least 20% less than the initial baseline airflow resistance.

23. The method of making a perforated cellular sound absorption material according to claim 13, wherein: the selected frequency range is from 0 Hertz to 2000 Hertz.

24. The method of making a perforated cellular sound absorption material according to claim 13, wherein: the selected frequency range is a limited frequency range within the frequency range of 0 Hertz and 10,000 Hertz; and the limited frequency range has a magnitude of less than 500 Hertz.

* * * * *